US011891717B2

(12) United States Patent
Lapelosa

(10) Patent No.: US 11,891,717 B2
(45) Date of Patent: Feb. 6, 2024

(54) ELECTRODE FOR A DOCTOR BLADE FOR PICKLING AND CLEANING METAL SURFACES

(71) Applicant: NITTY-GRITTY SRL, Sassuolo (IT)

(72) Inventor: Marco Lapelosa, Sassuolo (IT)

( * ) Notice: Subject to any disclaimer, the term of this patent is extended or adjusted under 35 U.S.C. 154(b) by 585 days.

(21) Appl. No.: 17/266,604

(22) PCT Filed: Aug. 5, 2019

(86) PCT No.: PCT/IT2019/050182
§ 371 (c)(1),
(2) Date: Feb. 7, 2021

(87) PCT Pub. No.: WO2020/031220
PCT Pub. Date: Feb. 13, 2020

(65) Prior Publication Data

US 2021/0310148 A1 Oct. 7, 2021

(30) Foreign Application Priority Data

Aug. 6, 2018 (IT) ..... 102018000007874

(51) Int. Cl.
*C25B 11/00* (2021.01)
*C25F 7/00* (2006.01)
*C25F 1/04* (2006.01)

(52) U.S. Cl.
CPC . *C25F 7/00* (2013.01); *C25F 1/04* (2013.01)

(58) Field of Classification Search
CPC ..... C25B 11/00; C25F 1/04; C25F 7/00
See application file for complete search history.

(56) References Cited

U.S. PATENT DOCUMENTS 4,609,450 A * 9/1986 Seimiya ..... B23H 5/06 204/217
2012/0006691 A1* 1/2012 Luo ..... B23H 7/26 204/224 R
2015/0014173 A1* 1/2015 Lapelosa ..... B23H 9/06 204/198

* cited by examiner

*Primary Examiner* — Zulmariam Mendez
(74) *Attorney, Agent, or Firm* — Patshegen IP; Moshe Pinchas

(57) ABSTRACT

An electrode for an electrolytically acting doctor blade (1) for pickling and cleaning both planar and curved metal surfaces, comprising a linear metal element supported on the structure of the doctor blade and electrically connected to the electric circuit for initiating the pickling electrolytic action; a pad made of a felt-like absorbent plastic material, resistant to high temperatures and to the chemicals contained in the electrolytic solution used; characterised in that a the linear metal element consists in a metal wire (8, 38), and a pad (7, 34, 41) having a constant thickness (S), made of a felt-like absorbent plastic material, resistant to high temperatures and to the chemicals contained in the electrolytic solution used, is wrapped therearound; the metal wire being connected to the structure of the doctor blade only at the ends of the doctor blade (25) in the active face of the deformable electrode (2, 20, 33, 35).
Different constructive forms of the electrode for doctor blade are described, wherein the metal wire is associated with carbon elements of various shapes to facilitate electrical contact with the pad.

11 Claims, 10 Drawing Sheets

ELECTRODE FOR A DOCTOR BLADE FOR PICKLING AND CLEANING METAL SURFACES

FIELD OF APPLICATION

The present invention relates to an electrode for an electrolytically acting doctor blade for pickling and cleaning metal surfaces which may be used also to treat curved surfaces, that is, the object of the present disclosure is the conformation of electrodes that may be mounted on a doctor blade, which, by applying the known electrolytic action to pickle or clean a surface by means of an electrolytic solution suitable to the metal surface being treated and to the type of deposit to be removed, allows to perform said treatment on typical planar surfaces or even, when supported in an appropriate deformable doctor blade, on curved surfaces whether they are convex, i.e., with the doctor blade and the electrode having a concavity, or concave, i.e., with the doctor blade and the electrode having a convexity adapted to the curvature of the surface being treated.

BACKGROUND ART

The prior art includes rectilinear doctor blades used for electrolytically pickling the metal surfaces to be treated, which are comprised of a basically rigid body of the doctor blade so as to act on the convex surface in a limited area of the length of the edge of the doctor blade itself, whereby the electrode used turns out to be rigid and not easy to deform. Moreover, such rectilinear doctor blades, i.e., with rectilinear electrode, when used on concave surfaces to be treated, can operate only by arranging the direction of the edge of the doctor blade parallel to the generatrix of both the concave and the convex curved surface. Actually, this electrolytic pickling operation is performed for the external cleaning, i.e., the convex cylindrical surface, or the internal one, i.e., the concave cylindrical surface, of tanks, reservoirs, containers and the like for liquids of a variety of food and non-food stuff, where said surfaces require a careful removal of deposits, dirt, internal, as well as external scales or patinas, which with use are formed on the metal surface of the tanks, reservoirs and containers themselves.

The aforementioned doctor blades are used by connecting the body of the doctor blade, i.e., of the electrode, to one end of the electric circuit for initiating the pickling electrolytic action, and the other electric end being connected or placed in electric contact with the surface to be treated. A pad, made of a fabric material resistant to the heat generated during the treatment and to the chemicals used in the electrolytic solution, is interposed between the electrode of the doctor blade and the surface; said pad is generally connected and movable together with the body of the doctor blade itself, i.e., of the electrode, which is soaked in an electrolytic solution suitable to the surface being treated and the type of scale, dirt, patinas or deposits to remove. The electrolytic solution can soak the pad by submerging it or by being supplied with a pump and a tube for feeding the solution from a reservoir connected or attached to the electric apparatus providing supply to the pickling circuit of the doctor blade.

Moreover, the said rectilinear doctor blades generally consist of the rigid electrode coated with the pad so as to implement the electrolytic action between the rigid electrode and the surface to be treated mediated by the flexibility of the pad. This way, the size of the resulting electrolytic cell is quite variable due to the variable thickness of the pad, when it is pressed between the rigid electrode and the metal surface being treated. In other words, even a typical rectilinear doctor blade has limitations in its use, since it is affected by the conformation and thickness of the pad made of a woven or felt-like material which does not have a constant thickness, and therefore the electrolytic effect is penalized and variable.

Moreover, in the background art, there are no known electrodes for doctor blades which show the required features of flexibility in use and are suitable to doctor blades having a deformable body to be used in the electrolytic pickling of metal surfaces; actually, said doctor blades need to be adaptable to the surfaces with curvatures to be treated to operate on a treatment surface or face that corresponding to the length of the doctor blade itself, i.e., of the electrode, making the doctor blade practically usable by the user in the various forms used for handling doctor blades for pickling metal surfaces in use.

Actually, a further limitation of the background art is that the known deformable doctor blade is not intended for any electrolytic pickling treatment of curved surfaces, leaving it to the user to follow expertly the curve of the surface being treated, therefore the background art does not suggest any means for transforming a doctor blade known in the art of metal surface electrolytic pickling with a structure and/or conformation of the electrode which, combined with the pad soaked in the electrolytic solution, required for the metal surface picking treatment, may be curved and modified in use by the user as desired.

Such prior art may be significantly improved as to the possibility of providing an electrode for an electrolytically acting doctor blade for pickling and cleaning both planar and curved metal surfaces, which overcomes the aforementioned limitations of the background art.

Therefore, the technical problem underlying the present invention is to provide an electrode for an electrolytically acting doctor blade for pickling and cleaning both planar and curved metal surfaces, which enables a constant functionality of the doctor blade in pickling both in the rectilinear form and with the curvature of the doctor blade, enabling the full functionality of the deformed electrode with curvature also with respect to the rectilinear doctor blade known in the art and of the pad interposed between the electrode and the surface being treated.

Moreover, there is the need of improving the background art in providing an electrode, usable with the typical rectilinear doctor blades, but allowing a uniform distribution of the electrolytic action between the electrode and the surface being treated.

An object inherent in the above technical problem is to provide a deformable electrode which adapts also to the arched conformation of the doctor blade, with the possibility of modifying the curvature from rectilinear to convex or concave, without disassembling the electrode from the doctor blade, but making it easy to fully replace the deformable electrode or of its parts when they are worn.

A further and not least object of the present invention is to provide deformable electrode configurations for a curved metal wall pickling and cleaning doctor blade in which the controlled supply of the electrolytic solution is maintained.

SUMMARY OF THE INVENTION

This problem is solved, according to the present invention, by an electrode for an electrolytically acting doctor blade for pickling and cleaning both planar and curved metal surfaces comprising: a linear metal element supported on the structure of the doctor blade and electrically connected to the electric circuit for initiating the pickling electrolytic action; a pad made of a felt-like absorbent plastic material, resistant to high temperatures and to the chemicals contained in the electrolytic solution used; characterised in that a the linear metal element consists in a metal wire, and a pad having a constant thickness, made of a felt-like absorbent plastic material, resistant to high temperatures and to the chemicals contained in the electrolytic solution used, is wrapped therearound; the metal wire being connected to the structure of the doctor blade only at the ends of the doctor blade in the active face of the deformable electrode.

Moreover, in an improved embodiment, carbon elements which continuously distribute the electrical current transmission contact on the pad and to the electrolytic solution with which it is imbued are placed between the metal wire, distributed over the length of the active face of the electrode, and the pad wrapped therearound.

In a further constructive form, the carbon elements are embodied by a carbon fibre braid placed between the metal wire, and in contact with it over the entire length of the aforementioned active face, and the inner surface of the pad wrapped around the metal wire.

Moreover, in an improved constructive form, the carbon elements are embodied by intertwined carbon fibres dispersed in the thickness of the pad wrapped around the metal wire; the contact between the metal wire and the carbon fibres present in the pad is implemented over the entire length of the aforementioned active face.

Furthermore, in a third embodiment, the carbon elements are embodied by graphite elements around which the pad is wrapped and individually fixed on each element; the metal wire is introduced and fixed on each graphite element forming the electrode.

Moreover, in a further variant of the preceding constructive forms, an inner pipe for feeding the electrolytic solution to moisten the pad is interposed between the aforementioned carbon elements and the wrapped pad.

Furthermore, in a specific improved embodiment, the electrode has a dorsal end to allow the doctor blade to be clamped; the dorsal end being aligned with the direction of the face of the doctor blade and with the active face of the electrode.

Moreover, in a further advantageous constructive form, a doctor blade has the electrode made according to one of the preceding constructive forms and has the electrode fixed to the doctor blade by means of tightening clamping elements of the electrode and an electrical connection for each of the ends of the metal wire forming the electrode.

Finally, a doctor blade with a specific advantageous form, in which an electrolytic solution supplying connection of the inner pipe for feeding the electrolytic solution to the pad is made, is provided.

Further features and advantages of the present invention, in the production of an electrode for an electrolytically acting doctor blade for pickling and cleaning both planar and curved metal surfaces, will be apparent from the following description of some constructive forms and embodiments, given by way of non-limiting example, with reference to the ten attached drawings.

DETAILED DESCRIPTION OF SOME PREFERRED EMBODIMENTS

Figure 1:
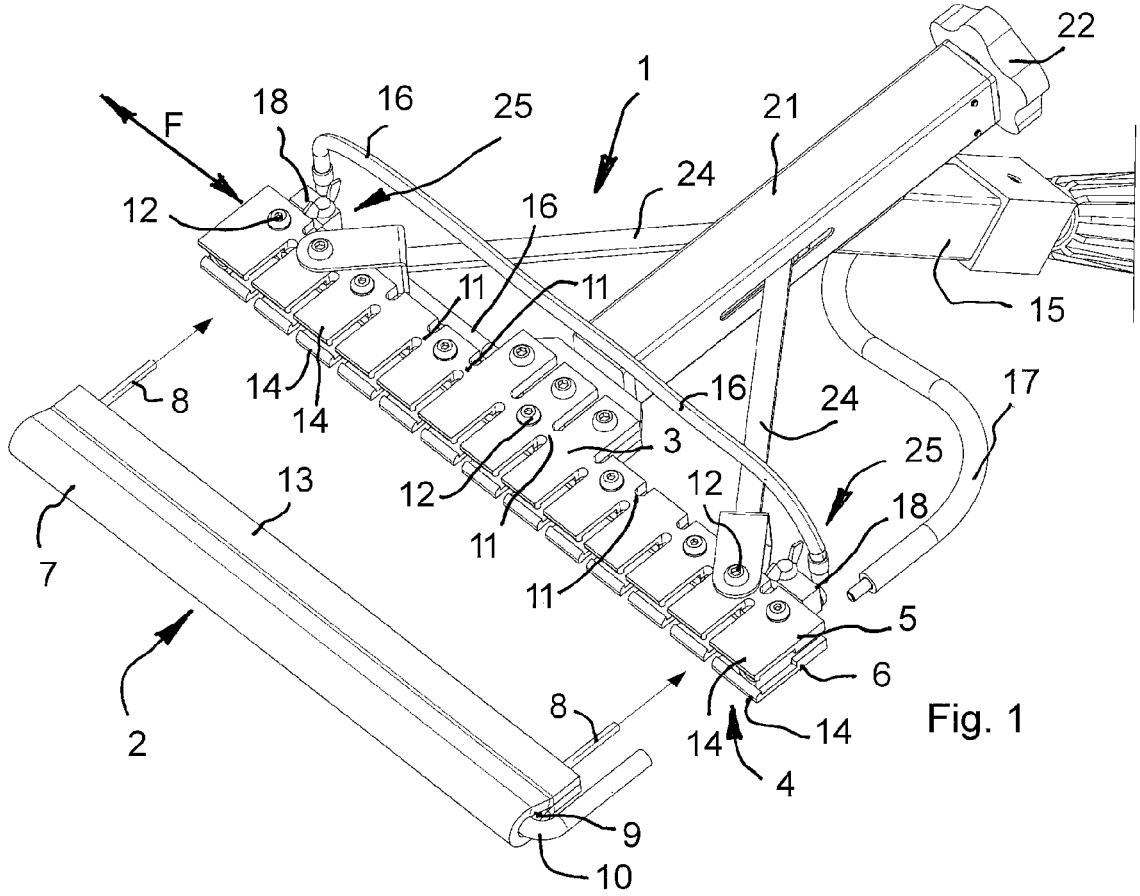
FIG. 1 shows a perspective and schematic view of an electrode and electrically acting doctor blade for pickling and cleaning both planar and curved metal surfaces, according to the invention, in the assembly step of the deformable electrode according to the invention in the deformable clamp of the doctor blade, depicted herein with a rectilinear conformation.
Figure 2:
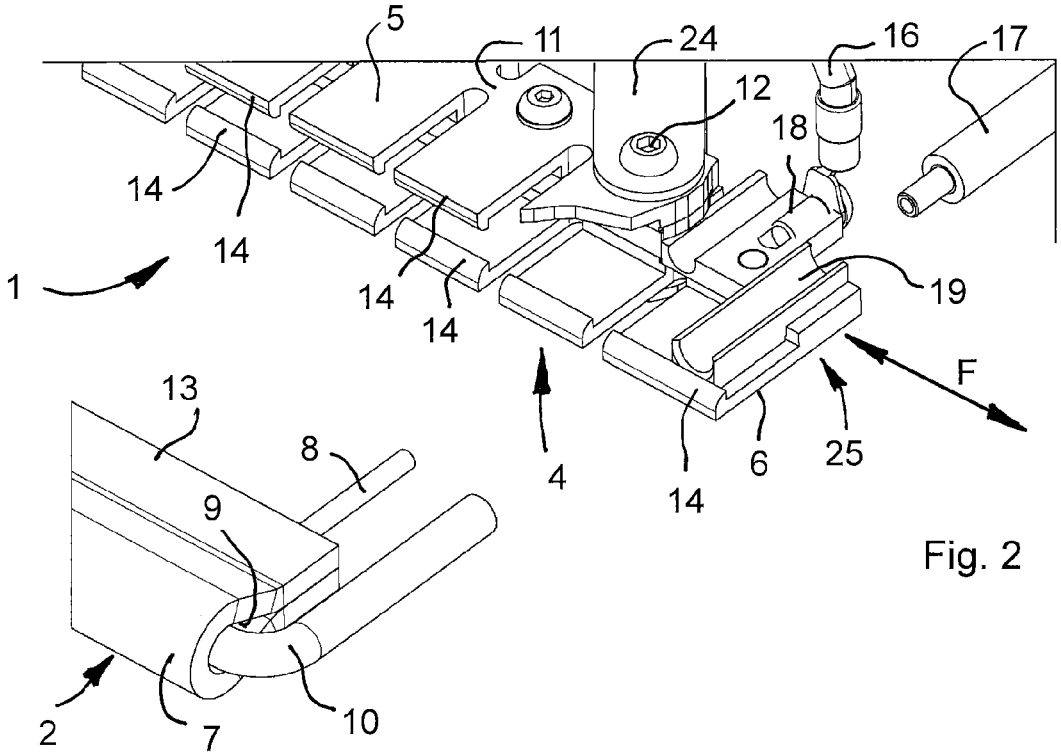
FIG. 2 shows an enlarged and limited perspective and schematic view of the doctor blade of FIG. 1 at the end of the electrode and the corresponding assembly position of the electrode itself on the clamp of the doctor blade with the electrode and electrolytic solution supplying connections.

FIGS. 1 to 4 show a doctor blade 1 provided with a deformable electrode 2, according to one of the constructive forms of the electrode described in the invention, in which the deformable electrode is supported and guided by a deformable body 3 of the doctor blade made up of upper 5 and lower 6 clamping elements 4, which, when tightened, grab the deformable electrode 2. The illustrated deformable electrode, embodied by the second constructive form described, comprises a pad 7 for winding a metal wire 8, conducting the electric current, with a carbon fibre braid 9 interposed to cover the inner surface of the pad; the deformable electrode is completed by an inner pipe 10 for feeding the electrolytic solution to the said braid 9 for covering the pad so as to generate the electrolytic action between the metal wire 8 of the electrode, the carbon fibre braid 9 and the surface being treated, in contact with the pad 7 soaked in an electrolytic solution.

The deformable body 3 of the doctor blade 1 is made by tightening the clamping elements 4 placed side by side and joined, in the direction F of the face of the doctor blade, i.e., the active face F of the electrode, by connections 11 between upper clamping elements 5, as well as between lower clamping elements 6, so as to achieve an increased pliability of the material forming the said clamping elements concentrated in such connections 11. There are tightening means 12, acting between said upper and lower clamping elements, which, when tightened, grab the dorsal end 13 of the deformable electrode 2 by means of teeth 14 on the outer surface of the pad 7 of such dorsal end.

A metal cable 16 for the electrical connection to the electrode and a pipe 17 for supplying the electrolytic solution to the doctor blade come out from the handle 15 of the doctor blade 1. In the end clamping elements 4 of the active face F of the electrode on the doctor blade 1, there are an electrical connection terminal 18 at each end, for supplying power to the metal wire 8, and, at least at one end, a connection 19 between the supplying pipe 17 and the inner pipe 10 for feeding the electrolytic solution into the pad, so as to make it easier to use for the operator.

Figure 3:
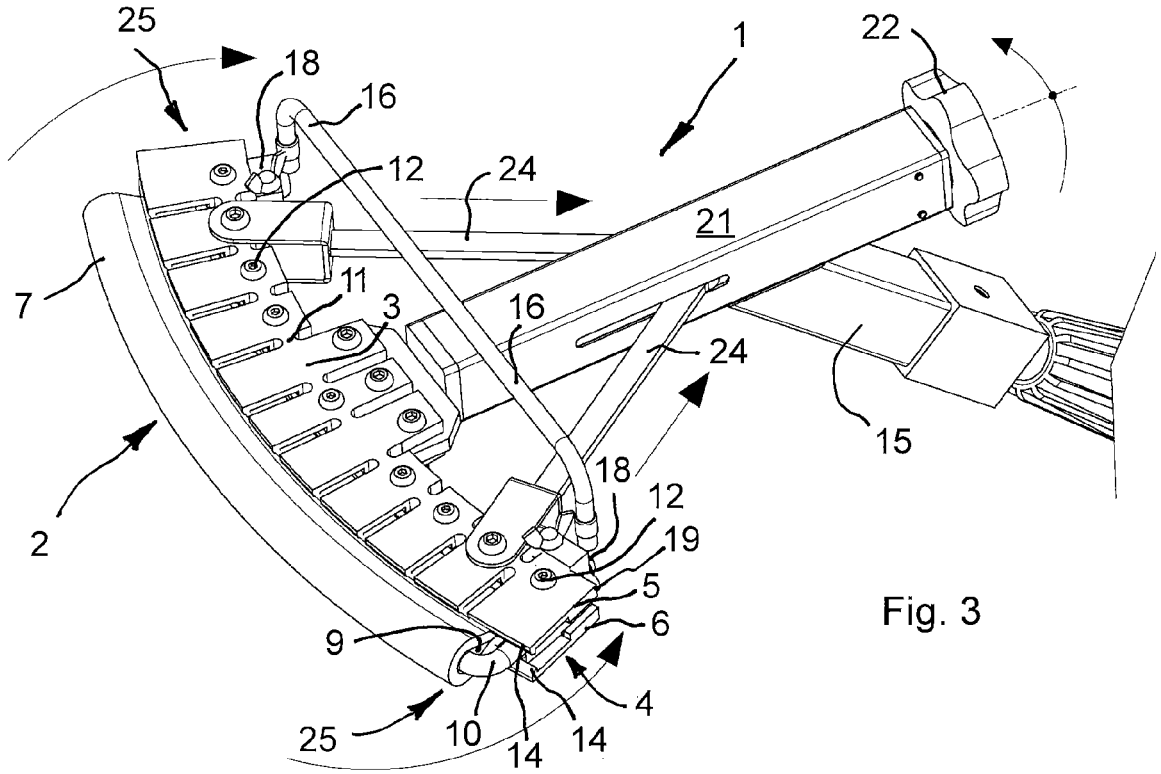
FIG. 3 shows a perspective and schematic view of the doctor blade and of the mounted electrode of FIG. 1 with the registration of the convex curvature, i.e., suitable for treating concave surfaces.
Figure 4:
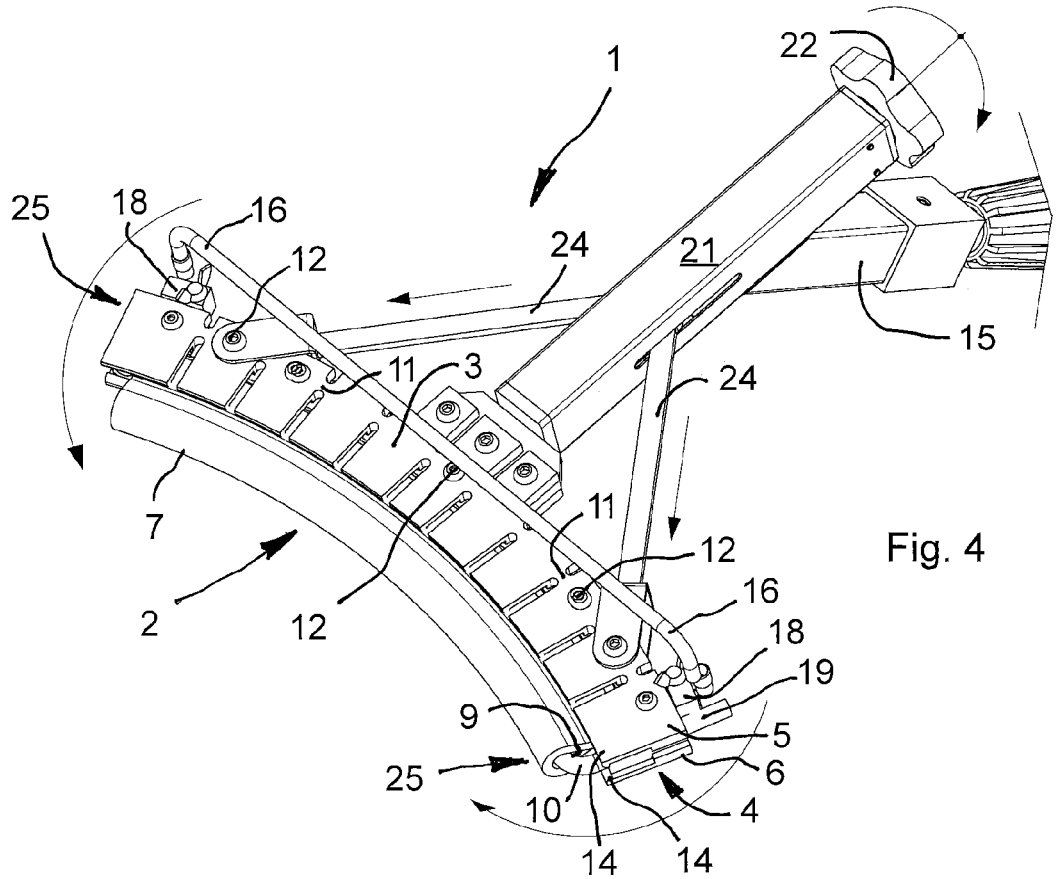
FIG. 4 shows a perspective and schematic view of the doctor blade and of the mounted electrode of FIG. 1 with the registration of the concave curvature, i.e., suitable for treating convex surfaces.
Figure 6:
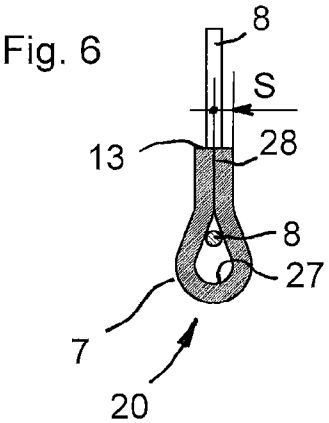
FIG. 6 shows a schematic section VI-VI of FIG. 5.
Figure 8:
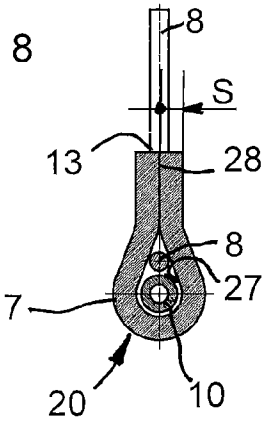
FIG. 8 shows a schematic section VIII-VIII of FIG. 7.
Figure 5:
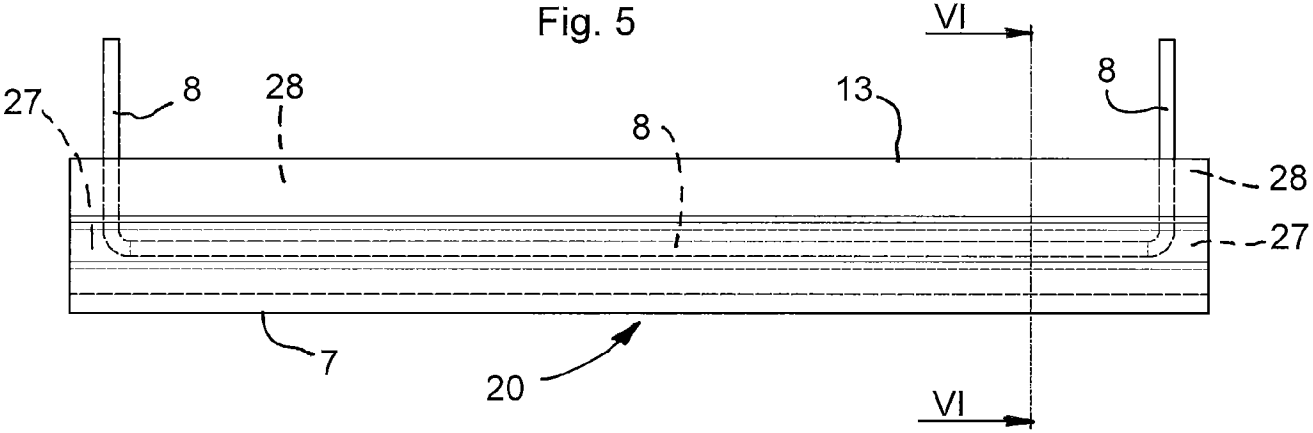
FIG. 5 represents a schematic side view of the deformable electrode in a simplified version, the first constructive form, of what is represented in FIG. 1, wherein the metal wire forming the electrode and the pad in contact with the surface to be treated, in which the electrode is inserted and is in contact with the inner surface of the pad, are highlighted.
Figure 7:
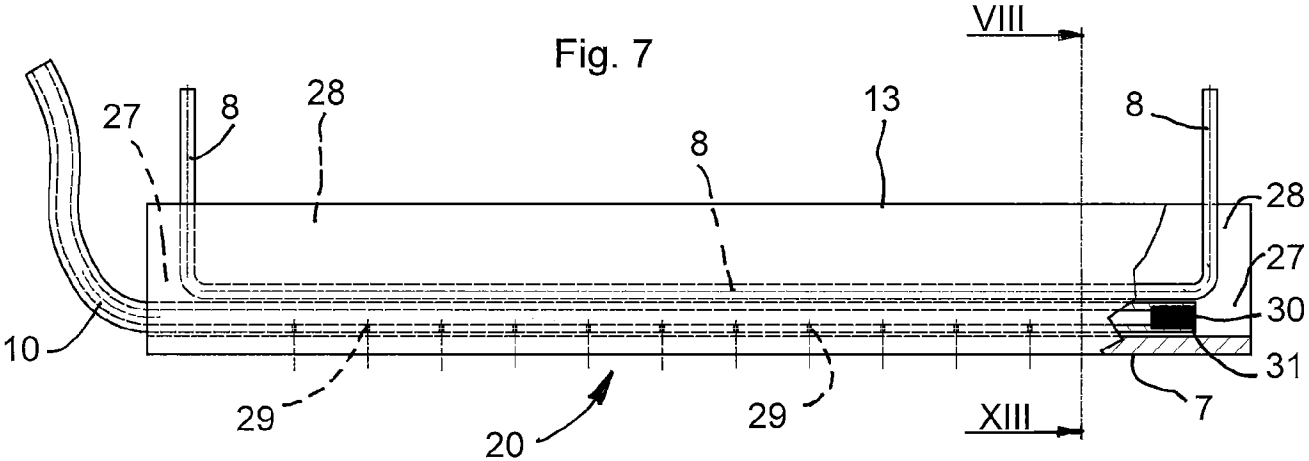
FIG. 7 represents a schematic and partially sectional view of the deformable electrode, as in FIG. 5, wherein the metal wire forming the electrode and the pad in contact with the surface to be treated, with the inner pipe for feeding the electrolytic solution interposed between the electrode and the inner surface of the pad, are highlighted.
Figure 10:
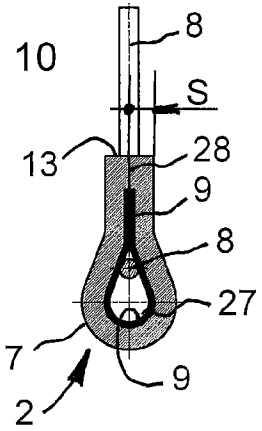
FIG. 10 shows a schematic section X-X of FIG. 9.
Figure 12:
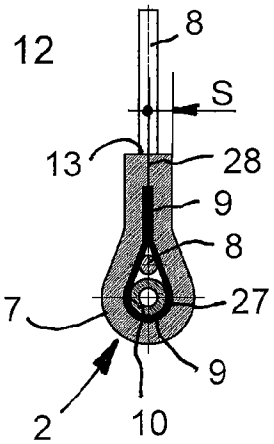
FIG. 12 shows a schematic section XII-XII of FIG. 11.
Figure 9:
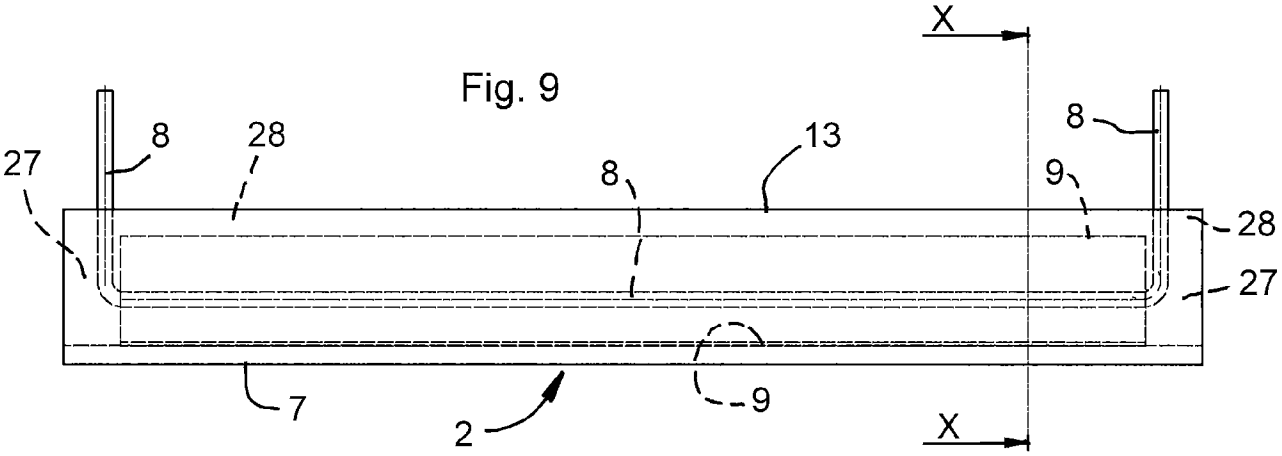
FIG. 9 shows a schematic side view of the deformable electrode in the second constructive form, wherein the metal wire forming the electrode, the inner carbon fibre braid and the pad in contact with the surface to be treated, interposed between the electrode and the inner surface of the pad on which the aforementioned inner braid is distributed, are highlighted.
Figure 11:
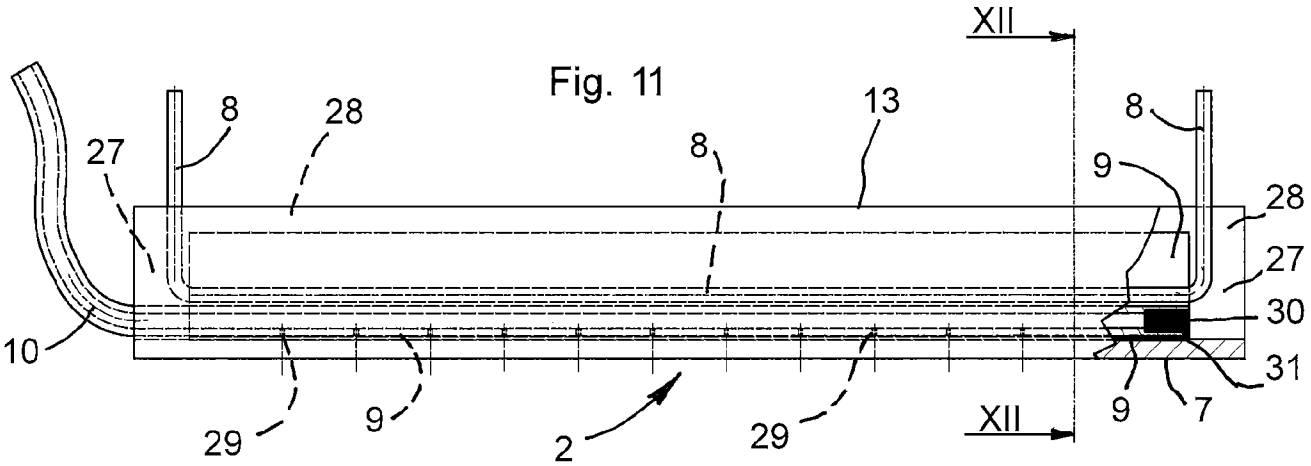
FIG. 11 shows a schematic and partially sectional view of the deformable electrode of FIG. 1, the second constructive form, wherein the metal wire forming the electrode, the inner carbon fibre braid and the pad in contact with the surface to be treated, with the inner pipe for feeding the electrolytic solution interposed between the electrode and the inner surface of the pad on which the aforementioned inner braid is distributed, are highlighted.
Figure 13:
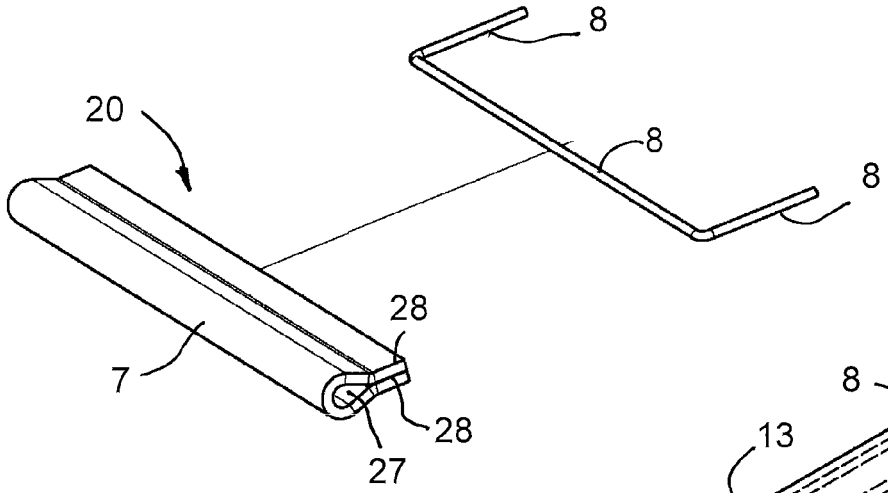
FIG. 13 shows a schematic perspective view of the deformable electrode in a simplified version of FIG. 5, the first constructive form, exploded in its constituent parts.
Figure 14:
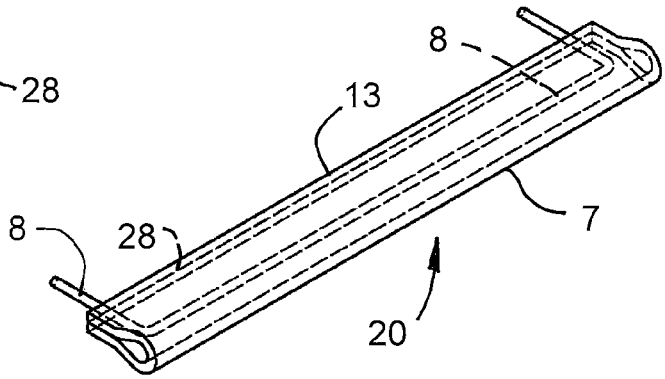
FIG. 14 shows a perspective and schematic view of the electrode of FIG. 5 fully assembled.
Figure 15:
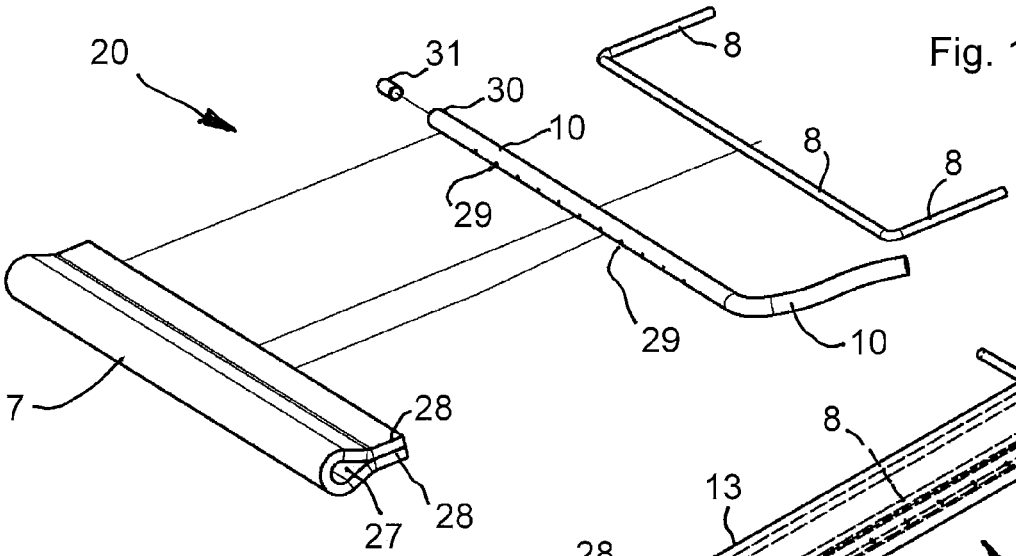
FIG. 15 shows a schematic perspective view of the deformable electrode with the inner pipe for feeding the electrolytic solution of FIG. 7 exploded in its constituent parts.
Figure 16:
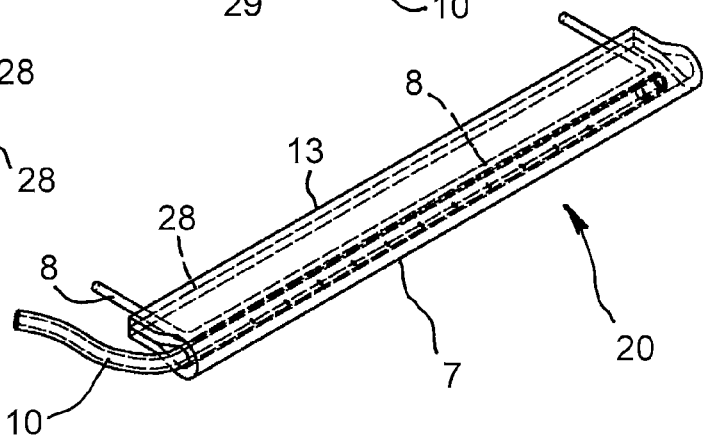
FIG. 16 shows a perspective and schematic view of the electrode of FIG. 7 fully assembled.
Figure 17:
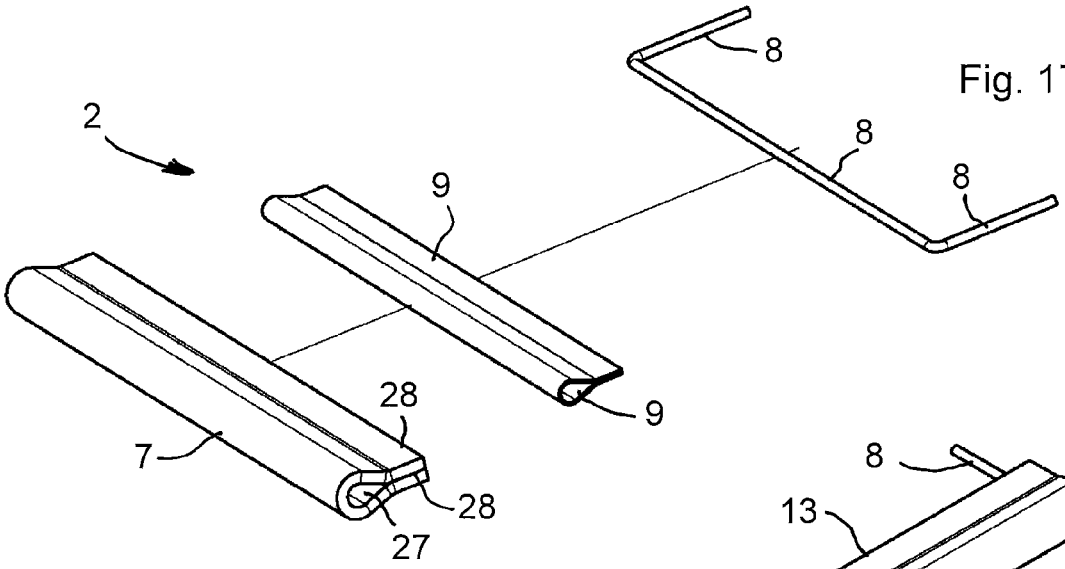
FIG. 17 shows a schematic perspective view of the deformable electrode of FIG. 9, the second constructive form, exploded in its constituent parts.
Figure 18:
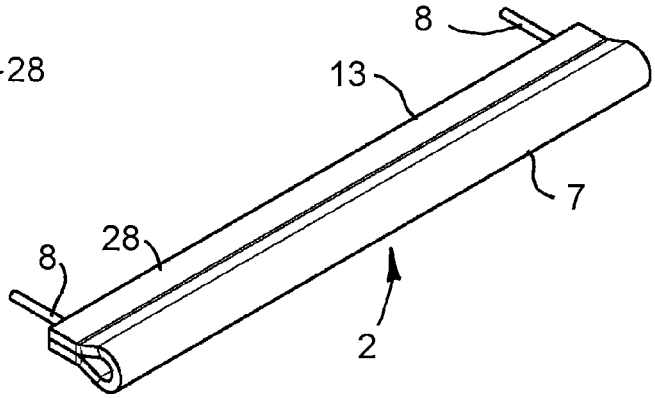
FIG. 18 shows a perspective and schematic view of the electrode of FIG. 9 fully assembled.
Figure 19:
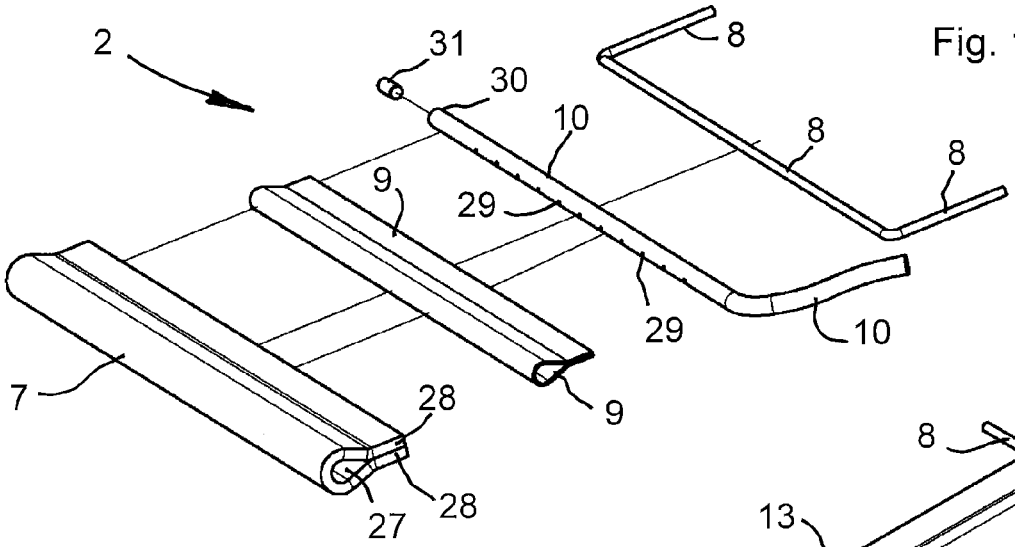
FIG. 19 shows a schematic perspective view of the deformable electrode with the inner pipe for feeding the electrolytic solution of FIG. 11 exploded in its constituent parts.
Figure 20:
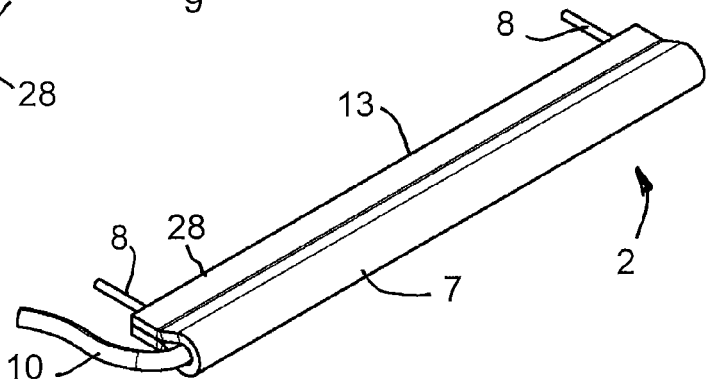
FIG. 20 shows a perspective and schematic view of the electrode of FIG. 11 fully assembled.
Figure 21:
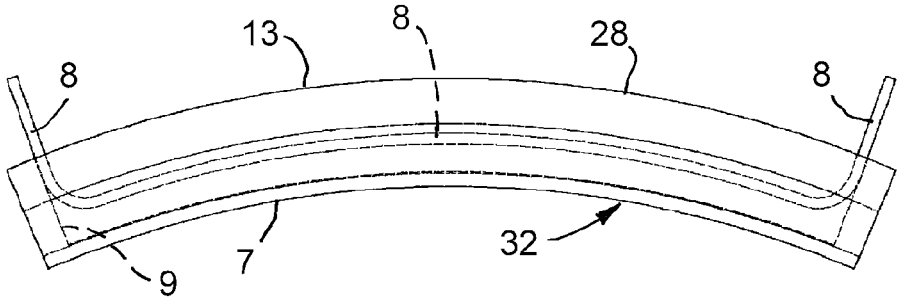
FIGS. 21, 22, 23, and 24 show side and perspective views of the electrode of FIG. 9 in the convex and concave curved position.
Figure 22:
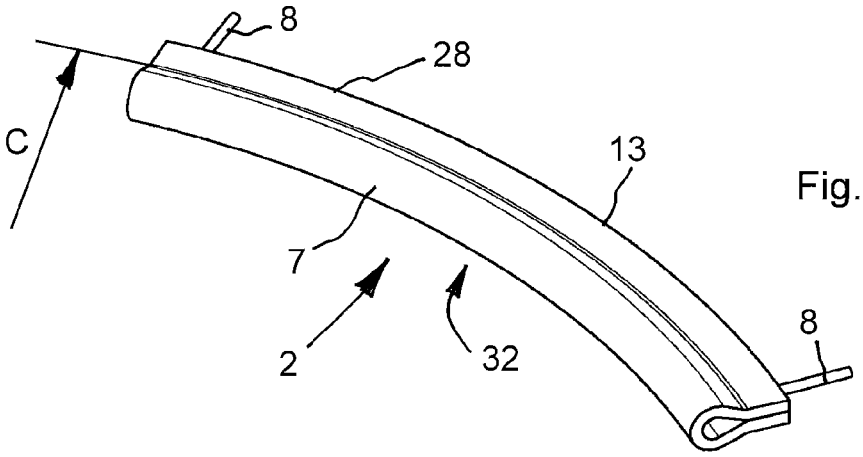
Figure 23:
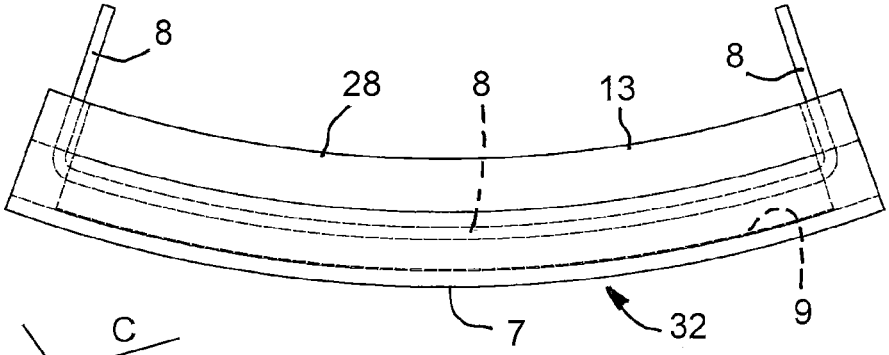
Figure 24:
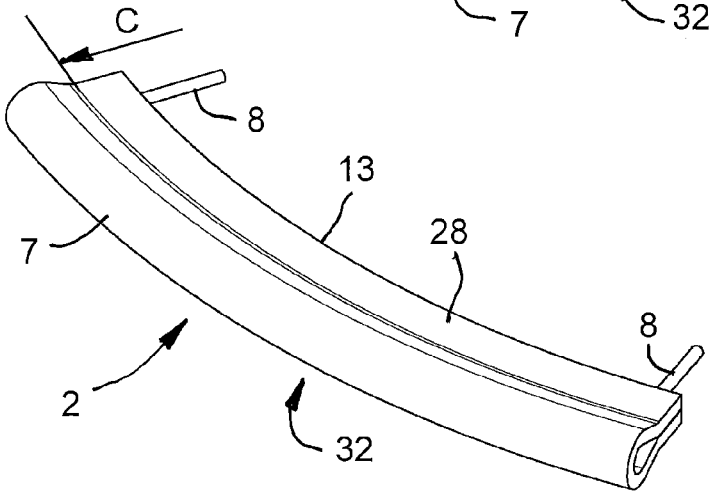
Figure 25:
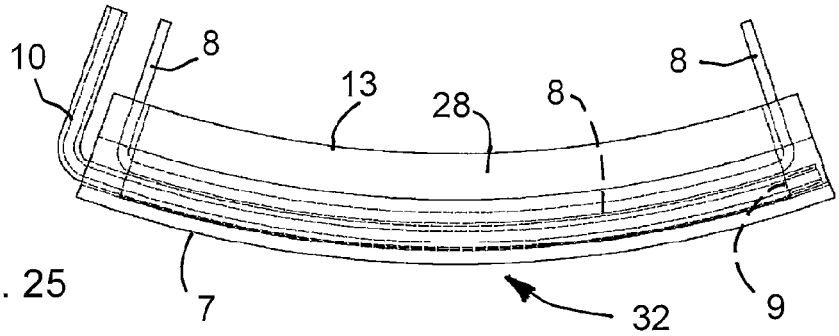
FIGS. 25, 26, 27, and 28 show side and perspective views of the electrode of FIG. 11 in the concave and convex curved position.
Figure 26:
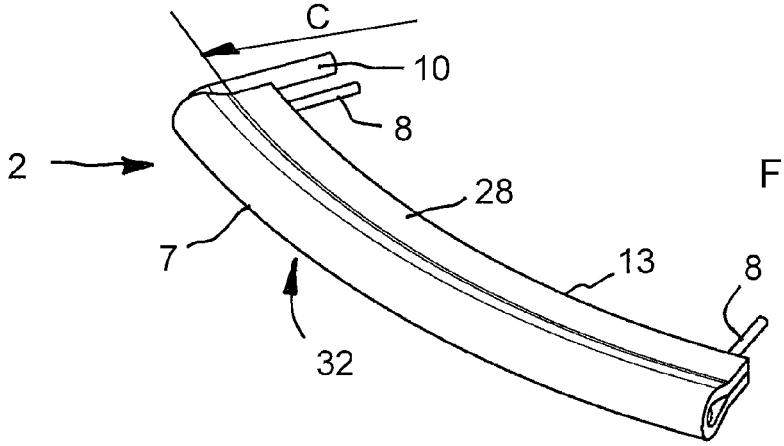

The doctor blade 1 is deformed to form a convex curvature, as shown in FIG. 3, or a concave one, as shown in FIG. 4, by acting on a slider, not shown, housed within the rail 21, placed between the handle 15 and the deformable body 3 of the doctor blade, and adjusted while moving towards the rail or moving away from it by means of a knob 22 acting on said slider; the slider is connected to push and/or pull rods 24 at the side ends 25 of the face F of the electrode on the doctor blade 1. As can be seen from the above figures, the curvature is made possible by the deformability of the pad 7, of the inner pipe 10, of the metal wire 8, of the deformable body 3 of the doctor blade on the connections 11, which takes place in the same face position of the doctor blade itself, i.e., by the deformation of the active face F of the electrode. The elongations or compressions occur mainly on the outer surface of the pad 7 which is at a greater distance from the metal wire 8 located close to the direction of alignment of the tightening means 12 and of the connections 11 between the clamping elements 4, forming the deformable body 3 of the doctor blade 1.

FIGS. 5, 6, 13, and 14 show the structure of the deformable electrode 20, embodied in the first simplified constructive form, herein provided with a wire 8 of the deformable electrode wrapped by the inner surface 27 of the pad 7; the metal wire 8 is in stable contact with said inner surface of the pad soaked in an electrolytic solution, so as to allow the electric current for actuating the electrolytic treatment to flow; the said inner surface 27 of the pad 7 is thus evenly supplied with the electric current and transfers the electrolytic action over the constant thickness S of the pad; thus the distance between a conductor, the metal wire, and the other conductor, the metal surface being treated, is constant for the activation of the pickling electrolytic action. The deformable electrode 20 is obtained by permanently joining the longitudinal ends 28 of the pad 7 in the dorsal end 13 of the deformable electrode.

FIGS. 7, 8, 15 and 16 show the structure of the deformable electrode 20, the first constructive form, herein provided with an inner pipe 10 for supplying the electrolytic solution, in which each similar or identical part is hereinafter referred to with the same numbering as in the preceding Figures. The metal wire 8 of the deformable electrode is wrapped by the inner surface 27 of the pad 7; the metal wire 8 is in stable contact with said inner surface of the pad soaked in an electrolytic solution, so as to allow the electric current for actuating the electrolytic treatment to flow; the said inner surface 27 of the pad 7 is thus evenly supplied with the electric current and transfers the electrolytic action over the constant thickness S of the pad; thus the distance between a conductor, the metal wire, and the other conductor, the metal surface being treated, is constant for the activation of the pickling electrolytic action. The deformable electrode 20 is obtained by permanently joining the longitudinal ends 28 of the pad 7 in the dorsal end 13 of the deformable electrode. Finally, in this version of the first constructive form, the inner pipe 10 for supplying the electrolytic solution releases the solution over the length of the pad 7 from equally spaced holes 29, so as to keep the pad strip facing the metal surface being treated moistened; the inner pipe 10 terminates at one end 30 with a plug 31.

FIGS. 9, 10, 17, and 18 show the structure of the deformable electrode 2, in the second constructive form already described in the preceding FIGS. 1-4, similar to the deformable electrode 20 described above but here lacking an inner pipe for supplying the electrolytic solution. This second constructive form of the deformable electrode is embodied by interposing a layer of carbon fibre braid 9 between the metal wire 8 and the inner surface 27 of the pad 7.

FIGS. 11, 12, 19 and 20 show the structure of the deformable electrode 2, in the second constructive form of the deformable electrode, herein provided with an inner pipe 10 for supplying the electrolytic solution, in which each similar or identical part is hereinafter referred to with the same numbering as in the preceding Figures. The metal wire 8 of the deformable electrode is wrapped by the inner surface 27 of the pad 7 on which the carbon fibre braid 9 is associated; the braid and the wire 8 are in stable, yet not tight contact, so as to allow the electric current for actuating the electrolytic treatment to flow; the distribution of the braid 9 allows the inner surface 27 of the pad 7 to be evenly supplied with the electric current so as to keep, at the thickness S of the pad, the distance between a conductor, the carbon fibre braid 9, and the other conductor, the metal surface being treated, constant for the activation of the pickling electrolytic action. The deformable electrode 2 is obtained by permanently joining the longitudinal ends 28 of the pad 7 in the dorsal end 13 of the deformable electrode. Finally, the inner pipe 10 for supplying the electrolytic solution releases the solution over the length of the pad 7 from equally spaced holes 29, so as to keep the pad strip facing the metal surface being treated moistened; the inner pipe terminates at one end 30 with a plug 31.

It should be noted that FIGS. 21 to 24, illustrating the deformable electrode in the second constructive form, also depict the curvature which can be achieved also in the first electrode construction form; the curvatures show the deformations with curvature C of the deformable electrode 2 in which the compressed or elongated fibres mainly appear on the outer surface 32 of the pad and, correspondingly, on the longitudinal end 28 thereof.

Figure 27:
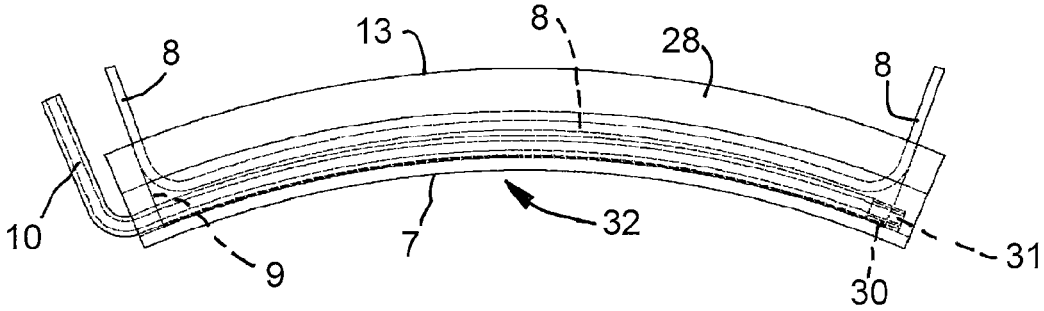
Figure 28:
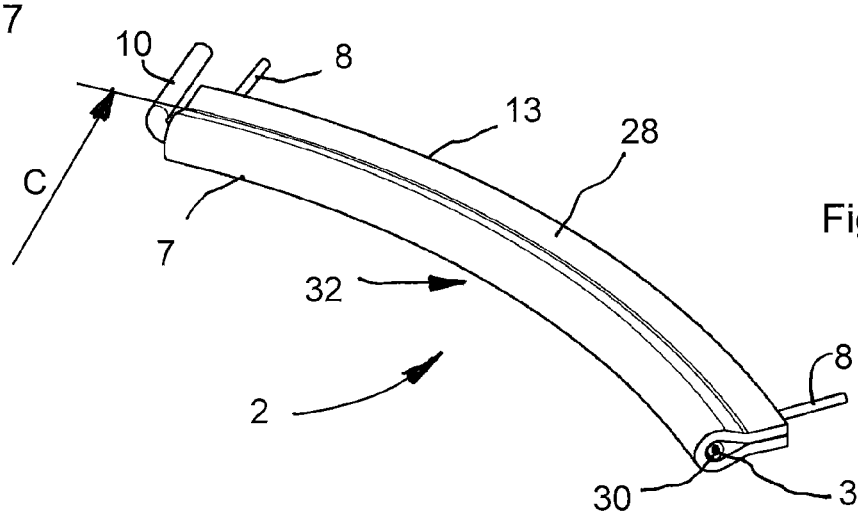

FIGS. 25 to 28 show the deformations with curvature C of the deformable electrode 2 in the second constructive form, but which also depict the curvature which can be achieved also in the first constructive form of deformable electrode, in which the compressed or elongated fibres mainly appear on the outer surface 32 of the pad or, possibly, on the longitudinal end 28 thereof; the inner pipe 10 in the concave conformation of FIGS. 27 and 28, maintaining its own length unchanged, brings the end 30 closer to the termination of the pad by sliding therein.

Figure 29:
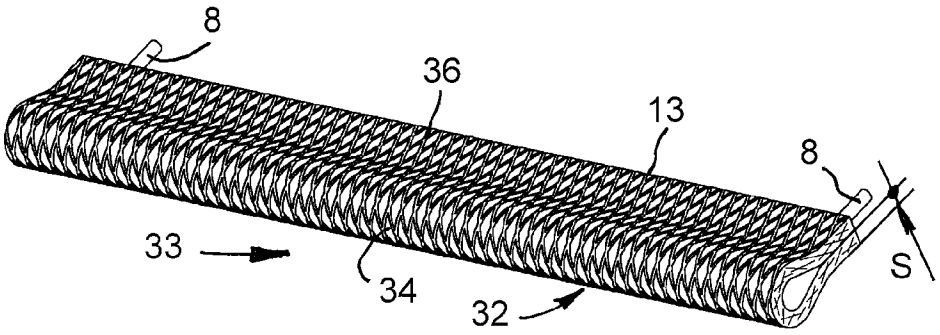
FIGS. 29 and 30 show schematic perspective views of an electrode in a third constructive form in which the inner carbon fibre braid is distributed in the thickness of the woven or felt pad, which comes into contact with the surface to be treated; the Figures show the alternatives with or without the pipe for feeding the electrolytic solution.
Figure 30:
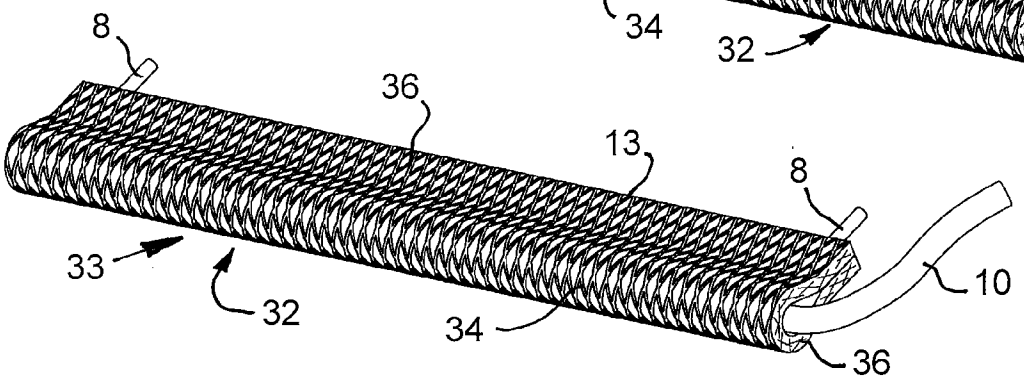

FIGS. 29 and 30 show the third constructive form of the deformable electrode 33, possibly provided with an inner pipe 10 for supplying the electrolytic solution to the pad 34 in the manner described for the constructive forms of the deformable electrode 2 and 20. In this embodiment, the carbon fibre braid 9 is replaced by a distribution of intertwined carbon fibres 36 immersed in the thickness S of the pad, they being in contact with one another in the thickness of the pad and in contact in the inner surface of the pad 34 with the metal wire 8, which is placed as the deformable electrodes 2 and 20, while outside on the surface 32 for the contact between the pad 34 and the metal surface being treated, such fibres 36 emerge, showing their mutual intertwining visible in Figure. The deformable electrode of the third constructive form can thus similarly be provided without an inner pipe 10 for supplying the electrolytic solution to the pad 34. This deformable electrode 33 is assembled and used as described for the deformable electrodes 2 and 20 above. Likewise, the curvatures achievable by this third constructive form are similar to those of the two preceding constructive forms.

Figure 31:
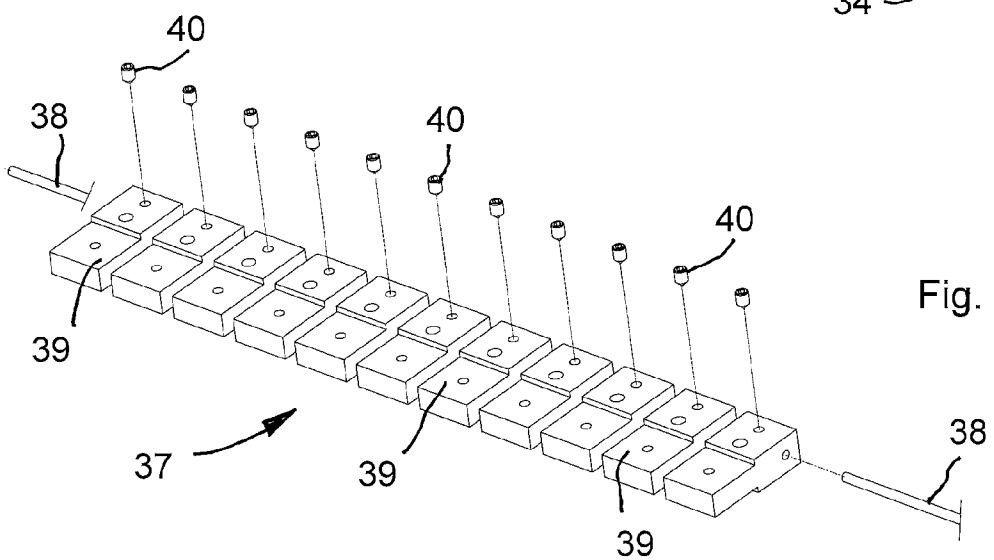
FIG. 31 shows a schematic perspective view of a fourth constructive form of the electrode, according to the invention, consisting of graphite blocks mounted spaced apart and separated but joined, over the length of the action face of the electrode, by the metal wire providing the power supply to the electrode.
Figure 32:
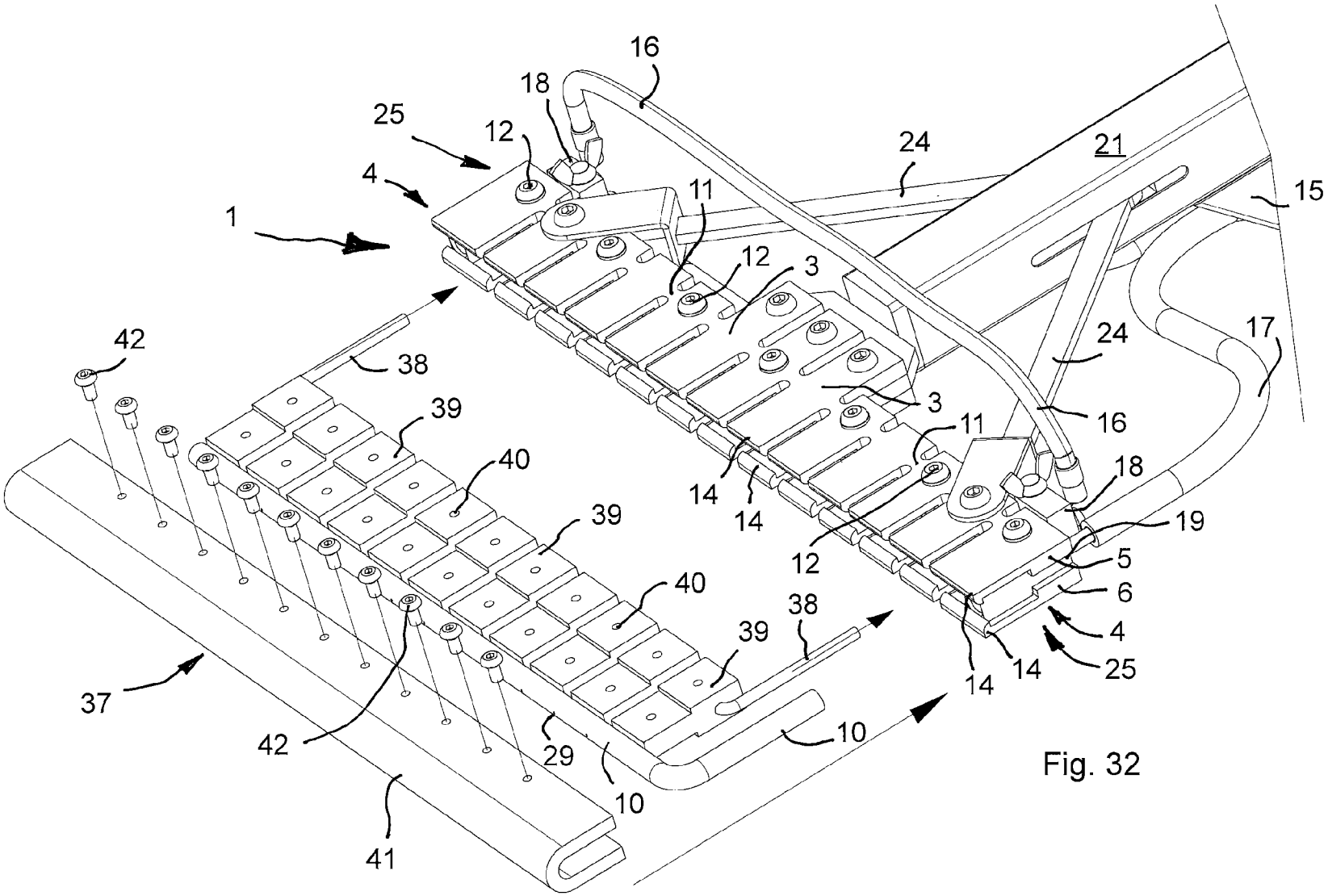
FIG. 32 shows a schematic perspective view of a doctor blade, as FIG. 1, with the electrode while it is mounted on it, consisting of the fourth constructive form according to the invention; the graphite blocks are grabbed by the clamping elements of the doctor blade, and the pad is fixed in an advantageously removable manner on the graphite blocks themselves.

Moreover, FIGS. 31 and 32 show the fourth constructive form of the graphite deformable electrode 37. The metal wire 38 in this form of the electrode is inserted in dedicated holes of each graphite element 39 which are fixed onto the metal wire, equally spaced, as much as the clamping elements 4, by means of removable fasteners, not shown, fixing the graphite elements so that they are spaced apart and, therefore, couple with the said clamping elements 4 of a doctor blade 1. In this constructive form of the graphite deformable electrode 37, there is also the supply of electric current in the same way as in the preceding FIGS. 1-4, and the supply of electrolytic solution by means of an inner pipe 10 inserted between the front ends of the graphite elements 39 and the inner surface of the pad 41. The pad is fixed onto the graphite elements by means of removable elements 42 so as to make it replaceable, when needed. The electrolyte solution is supplied in the same way as in the preceding constructive form by means of the inner pipe 10, or in an uncomfortable way for the user by dipping the pad 41 in case the pipe 10 for supplying the electrolytic solution is not present.

The fourth constructive form, shown in FIG. 32, of deformable electrode 37 with graphite elements 39, present the graphite elements 39 made to be housed within the clamping elements 4 already present in the first constructive form of the doctor blade 1 described. The doctor blade 1 is made similarly to the doctor blade of the preceding Figures and tightens each graphite element 39 of the graphite deformable electrode by means of the teeth 14 in each, both upper and lower, clamping element 4, i.e., this constructive form of deformable electrode 37 is interchangeable as the deformable electrodes 2, 20, and 33. In this constructive form, the conformation of the pad 41 soaked in the electrolytic solution is fixed with removable elements 42 to each graphite element 35 of the graphite deformable electrode 34. The identical or similar parts of the preceding constructive forms are referred to with the same numbering, such as the metal wire 38 which, after having been tightened to each graphite element 39, is inserted into the terminals 18 of the doctor blade 1 in the same way as the metal wire 8.

In the described constructive forms of the deformable electrode, the metal wire is advantageously made of nickel or tungsten, and the pads are made from a felt-like fabric made of a heat-resistant plastic material produced during the treatment and under the action of the chemicals present in the electrolytic solution used. Said plastic material is typically known as PEEK, the trade name of polyetheretherketone, or also as ZYLON, trade name, with the most suitable thickness of the pad in relation to the pickling effect to be achieved. Finally, the carbon elements, indicated as facilitators of the electrical connection between the metal wire and the wrapped pad, can be made of solid graphite, i.e., a mechanically rigid amorphous carbon, as well as with carbon fibre braid or intertwined carbon fibres dispersed in the thickness of the pad itself.

The deformable electrode for a doctor blade according to the invention is used as described for the adjustment of the curvature of the doctor blade 1 by acting on the position of the slider and of the ends 25 of the doctor blade with respect to the middle part of the doctor blade which is connected with the rail 21. After a deformable electrode has been mounted, the doctor blade may be moistened with the electrolytic solution fed into the deformable electrode through the pipe 10 and the holes 29 which it has in the section in contact with the pad 7, 34, or 41. The doctor blade may also be equipped with non-deformable electrodes, but this does not diminish its innovative characteristics, this being a transient effect in that, as visible and manageable, the arched conformation of the doctor blade is one potential use, but the doctor blade 1 may still be used with the rectilinear face F for treating flat surfaces, therefore the electrodes illustrated in the present description, being deformable, may be used as assembled in rigid doctor blade with a rectilinear or arch-shaped, whether concave or convex, conformation of the active face F of the electrode, maintaining the fixed shape due to the doctor blade itself.

Besides, the presence of the pipe 10 for feeding the electrolytic solution is also optional. Actually, a fixed or deformable electrode 20, 33 may be provided without having the pipe 10 for feeding the electrolytic solution: to exploit the electrolytic pickling action, the operator will have to dip the pad of the doctor blade in use in a tray or bucket, not shown, to cause the pad 7, 34, or 41 itself to absorb the amount of electrolytic solution required each time to make the electrolytic action itself effective.

The advantages of using an electrolytically acting doctor blade for pickling and cleaning curved metal surfaces as described mainly result from the constitutive simplicity of the deformable electrode, both when it has the pad 7, as well as provided with or lacking the braid 9, or even with intertwined carbon fibres 36, distributed in the thickness of the pad 34, and in the versions of graphite deformable electrode 37, i.e., having the clamping elements 4 which are distributed in the direction of the face F of the doctor blade so as to make the alignment itself of the aforementioned clamping elements, and therefore of the graphite elements 39, deformable, to define the active face F of the electrode. By displacing the alignment position of the ends 25 of the doctor blade 1 with respect to the middle part, the push or pull mechanism on the rods 24 changes the shape of the pad into convex, linear straight or concave, and vice versa. The mechanism itself may be made differently from what has been described, but still suitable for moving forward (push) or backward (pull) the ends of the rods 24 connected to the slider sliding in the rail 21. The flexibility and deformability of the pad 7, 34, or 41 allows the outer surface of the pad to achieve the required curvature C of the face F of the doctor blade. In other words, the advantage that can be obtained is achieving the versatility of the face of the doctor blade 1, i.e., of the active face of the electrode, in adapting to the curvature most suited to the surface during a pickling or cleaning treatment, whether it is convex, planar or concave.

Obviously, a person skilled in the art, in order to satisfy specific and contingent requirements, may make numerous modifications to an electrode for an electrolytically acting doctor blade for pickling and cleaning both planar and curved metal surfaces, as described above, by the way all falling within the scope of protection of the present invention as defined by the following claims.

The invention claimed is:

1. A deformable electrode for an electrolytically acting doctor blade for pickling and cleaning both planar and curved metal surfaces, comprising: a linear metal element supported on the structure of the doctor blade and electrically connected to an electric circuit for initiating the pickling electrolytic action; characterized in that, the linear metal element consists in a metal wire, and a pad having a constant thickness, made of a felt-like absorbent plastic material, resistant to high temperatures and to the chemicals contained in the electrolytic solution used, is wrapped therearound; the metal wire being connected to the structure of the doctor blade only at the ends of the doctor blade in the active face of the deformable electrode.

2. Electrode for a doctor blade, according to claim 1, wherein carbon elements which continuously distribute the electrical current transmission contact on the pad and to the electrolytic solution with which it is imbued are placed between the metal wire, distributed over the length of the active face (F) of the electrode, and the pad wrapped therearound.

3. Electrode for a doctor blade, according to claim 2, wherein the carbon elements are embodied by a carbon fibre braid placed between the metal wire, and in contact with it over the entire length of the aforementioned active face (F), and the inner surface of the pad wrapped around the metal wire.

4. Electrode for a doctor blade, according to claim 2, wherein the carbon elements are embodied by intertwined carbon fibres dispersed in the thickness of the pad wrapped around the metal wire; the contact between the metal wire and the carbon fibres present in the pad is implemented over the entire length of the aforementioned active face (F).

5. Electrode for a doctor blade, according to claim 2, wherein the carbon elements are embodied by graphite elements around which the pad is wrapped and individually fixed on each element; the metal wire is introduced and fixed on each graphite element forming the electrode.

6. Electrode for a doctor blade, according to claim 1, wherein an inner pipe for feeding the electrolytic solution to moisten the pad is interposed between the aforementioned metal wire and the wrapped pad.

7. Electrode for a doctor blade, according to claim 1, wherein the electrode has a dorsal end to allow the doctor blade to be clamped; the dorsal end being aligned with the direction of the face of the doctor blade and with the active face (F) of the electrode.

8. Electrode for a doctor blade, according to claim 1, wherein the metal wire is made of nickel or tungsten.

9. Electrode for a doctor blade, according to claim 1, wherein the pad is made up of a plastic material filter made of PEEK, the trade name of polyetheretherketone, or also of ZYLON, trade name.

10. Doctor blade for an electrode for pickling and cleaning both planar and curved metal surfaces, wherein the deformable electrode is provided according to claim 1 and has the electrode fixed to the doctor blade by means of tightening clamping elements of the electrode and an electrical connection for each of the ends of the metal wire forming the electrode.

11. Doctor blade for an electrode, according to claim wherein an electrolytic solution supplying connection of the inner pipe for feeding the electrolytic solution to the pad is provided.

* * * * *